United States Patent [19]

Regueiro

[11] 4,111,177

[45] Sep. 5, 1978

[54] INTERNAL COMBUSTION ENGINE

[75] Inventor: Jose F. Regueiro, Muskegon, Mich.

[73] Assignee: Teledyne Industries, Inc., Los Angeles, Calif.

[21] Appl. No.: 728,068

[22] Filed: Sep. 30, 1976

[51] Int. Cl.[2] ..... F02B 3/00

[52] U.S. Cl. ..... 123/32 ST; 123/32 SA; 123/32 E

[58] Field of Search ..... 123/32 ST, 32 SP, 191 S, 123/191 SP, 32 SA, 32 F

[56] References Cited

U.S. PATENT DOCUMENTS

| | | | |
|---|---|---|---|
| 2,767,692 | 10/1956 | Barber | 123/32 ST |
| 3,283,751 | 11/1966 | Goossak et al. | 123/32 SP |
| 3,508,530 | 4/1970 | Clawson | 123/32 ST |

FOREIGN PATENT DOCUMENTS

| | | | |
|---|---|---|---|
| 830,583 | 7/1949 | Fed. Rep. of Germany | 123/32 SP |
| 2,445,492 | 1/1976 | Fed. Rep. of Germany | 123/32 SP |

*Primary Examiner*—Ronald B. Cox

*Attorney, Agent, or Firm*—Gifford, Chandler, VanOphem, Sheridan & Sprinkle

[57] ABSTRACT

A stratified charge, internal combustion engine having a cylinder, a piston reciprocally disposed within the cylinder, a head secured over the cylinder, a chamber in the head above the cylinder, an air pocket adjacent the chamber and extending radially beyond the projected boundaries of the cylinder, a fuel injection system supplying fuel to the chamber by means of a fuel nozzle in the chamber which projects a stream of fuel through the chamber and into the air pocket, and ignition means positioned within the chamber and within the trajectory of the injected fuel to initiate combustion of the fuel.

In operation, the initial portion of the fuel injected through the chamber is ignited by the ignition means so that a flame front propagates through the chamber. Fuel subsequently injected passes through the flame front and into the air pocket undergoing further atomization, vaporization and preflame reactions through the highly turbulent primary combustion zone so that complete combustion of the total fuel injected is achieved.

8 Claims, 6 Drawing Figures

INTERNAL COMBUSTION ENGINE

BACKGROUND OF THE INVENTION

I. Field of the Invention

The present invention relates generally to internal combustion engines, and more particularly, to an open chamber stratified charge internal combustion engine.

II. Description of the Prior Art

Stratified charge combustion is well known and quite old in the art of internal combustion engines. Theoretically speaking, any engine in which the fuel and air are not intimately mixed throughout the combustion space during the combustion time is defined as a stratified charge engine. In this broad, theoretical sense any type of compression engine is a stratified charge engine.

A more practical definition, and one now commonly accepted throughout the world, would include, as a stratified charge engine, all engines in which: (1) the mixture is not homogenous throughout the combustion space and (2) combustion is initiated by outside electrical means.

As such an engine can have either two totally different homogenous mixtures of different air/fuel ratios or a multiplicity of air/fuel ratios across its combustion space, and be called a stratified charge engine. Typical of the first of these are so-called divided chamber or precombustion chamber stratified charge engines, which normally employ two well defined combustion chambers. The second would include all so-called open chamber stratified charge engines.

Divided chamber stratified charge engines, dating back more than 60 years, have received considerable attention lately and have even been introduced commercially. These engines work with a rich, ignitable ratio in the small precombustion chamber and load dependent, variably lean ratios in the main combustion chamber. The main advantage of this system is that it lends itself well to outside controls to produce a reasonably clean exhaust. The control flexibility of the system allows it to be programmed to comply with the varying requirements of different testing cycles. The disadvantages of this system are: (1) low thermal efficiency; (2) the requirement for complicated and sensitive control mechanisms; and (3) the inability of such engines to yield both high economy and low exhaust emissions at the same time.

In general, open chamber stratified combustion engines are very closely linked to open chamber compression ignition engines enjoying many of their good characteristics while correcting or improving upon those which are unacceptable. Like open chamber diesels, the air intake is basically unthrottled for high volumetric efficiency and minimum pumping losses. Supercharging is easily accomplished since only air needs to be handled. Combustion is accomplished by electrical ignition of the injected fuel rather than by the high compression pressures and temperatures required by open chamber compression ignition engines to achieve auto-ignition of the fuel.

In open chamber stratified charge engines, the compression ratio can be adjusted for the optimum compromise between thermodynamic efficiency and friction, mechanical loads, manufacturing tolerances, etc., that is at approximately 11 to 13:1. Combustion proceeds smoothly, devoid of the high noise and firing pressures characteristic of open chamber diesel combustion.

Auto-ignition of the fuel, the heart and essence of compression ignition engines, remains, to this day, as the worst drawback of this type of engine. Long delays between the beginning of injection and the initiation of combustion result if the compression ratio is too low. To reduce the delay to produce quiet operation and high speed capabilities requires compression ratios over 20:1. Delay time is also a controlling factor in emissions of oxides of nitrogen. With long delay time there is uncontrollable burning and heat release of a large quantity of the fuel introduced during the delay period producing relatively high amounts of $NO_x$ as well as noise. Open chamber stratified charge engines, by initiating combustion through spark ignition, operate with controlled delay times and, therefore, produce smooth, noiseless ignition with minimum amounts of oxides of nitrogen.

The relatively long time delays typical of open chamber compression ignition engines have prevented these power plants from operating at the rotational speeds required by light duty automotive applications.

Open chamber, stratified charge engines exhibit the good nozzle related hydrocarbon emissions profile as previously explained, but with some designs in which the fuel makes excessive wall contact prior to combustion, hydrocarbon emissions are relatively high due to the wall quenching effects. In some cases, especially with fuels which may generate odoriferous compounds, exhaust odor can be very noticeable.

In summation the failure of most open chamber stratified charge engines has been the basically unconfined design of the chamber, reminiscent of an open pot in which air, fuel, and spark are thrown together with little but hope that combustion will take place as originally intended.

SUMMARY OF THE PRESENT INVENTION

The open chamber stratified charge engine of the present invention enjoys all of the theoretical advantages of this type of engine but solves the problems of atomization, mixing, vaporization, ignition and beginning of combustion by relying first on piston-generated turbulence (squish) as well as positive and straight forward positioning of the fuel nozzle and igniting means within a relatively constrained portion of the combustion chamber, and then, after combustion begins, by forcing the subsequent injection of fuel past the highly turbulent flame front, where the fuel undergoes preflame reactions prior to encountering the main charge of air on the other side of the chamber.

Piston-generated turbulence (squish) is far superior to port generated turbulence in promoting the required in cylinder air motion needed by this application because first, it does not require special swirl-inducing intake ports, which restrict the air flow; second, because the unidirectional turbulence thus generated by the piston is an important consideration in promoting the type of combustion herein being described, and third, because the air motion is generated just prior to combustion, not through a breathing process leading it by more than three-quarters of a revolution.

Spark ignition of a high turbulent lean mixture has already beeh proven successful, extremely so if based on an orderly sequence employing squish-generated unidirectional turbulence upstream of the ignition source as described in my U.S. Pat. No. 3,945,365 (Low Emission Combustion System for Internal Combustion Engines Utilizing Multiple Spark). Positive mixture ignition by placement of the fuel nozzle so that the injected fuel mixes with air flowing in essentially the same direction (unidirectional turbulence), before passing by the electrical ignition means has generally been utilized also by practically all industrial burners and gas turbines ever made, as well as by the latest Curtiss-Wright fuel-injected, stratified charge rotary engines.

The open chamber stratified charge engine herein described makes as much use of the unidirectional turbulence and orderly sequence already explained as those examples mentioned, but introduces extremely high mini-swirls and eddies (multidirectional turbulence) to the squish turbulence along the channel encompassing the primary combustion air and early injection of fuel, between the points of fuel injection and mixture ignition, to assure an even more positive ignition and fast establishment of the moving flame front through which the injection of successive and additional fuel quantities must pass prior to reaching the fresh air charge in the larger volume of the chamber.

Because of the highly reduced ignition delay and improved mixing and vaporization of the main fuel charge, plus extremely turbulent chamber conditions during combustion, many of the disadvantages of open chamber compression-ignition engines are overcome: high speed capabilities, low speed, low load operations at retarded timings for minimum noise and oxides of nitrogen, high load air utilization without smoke, etc. With this system, because of its fast secondary combustion, optimum operation occurs when heat begins releasing at or close to TDC, eliminating or reducing the indicated negative work due to early combustion and other frictional and heat transfer losses that accompany the early heat release needed by other combustion processes. Combustion with this process could be described as closely approaching the highly efficient constant pressure thermodynamic cycle. In this fashion, the mechanical efficiency of the engine is improved, with direct favorable implications on the fuel economy. Because of practically minimum "wall wetting" and the preferred use of single orifice, outward opening nozzles the emissions of unburned hydrocarbons can be as low as the best divided chamber, compression-ignition engines, certainly much lower than with present state of the art open chambers, either stratified or compression ignition. By the same reason, low odor levels can also be achieved.

As already explained, the intake port for this engine need not be restrictive like other open chamber engines needing high amounts of port swirl. Without artificial restrictions, the intake ports can be as direct and as large as physically allowed by other design considerations. Further enhancing the volumetric efficiency of this engine is the use of very large intake valves, conceivably as large as 60 or 65% of the bore diameter. With the intake valve seating in the combustion chamber cast in the head, there is no limitation as to the opening time of the valve as there is in naturally aspirated, open chamber compression ignition engines in which serious restrictions are imposed on the designer, who is confronted on the one hand by the need to avoid hitting the valves with the piston and on the other hand by the required high compression ratios with minimum valve recesses or piston cut-outs. With the chamber as herein described, then, the designer comes as closely as possible to total freedom in positioning and laying out the ports and valve train mechanism. This freedom of design can be visualized by the fact that valve lay out can be: OHV (push rod operated, SOHC or DOHC) "F" head or "L" head, as determined by performance and cost. Based on these designs with the F head or OHV approach, the alternative of three valve operation is quite likely. These three valves can be either one inlet and two exhaust valves or two inlet valves and one exhaust valve.

In two valve OHV and "F" head designs, the intake valve preferably lies above the cylinder, offset towards the side pocket of the chamber and actuating either vertically or at a small angle off the vertical. With "F" head valve designs, the possibility also exists of having the intake valve partially over the cylinder bore and partially in the side pocket L, even to the point of laying somewhat over the exhaust valve. Since the depth of the pocket over the exhaust valve must allow for full exhaust valve lift, physical interference between both valves does not occur unless the combined lifts of the intake and exhaust valves during the overlap period exceeds the single lift of any of the valves, a rather unlikely condition but nevertheless one which provides the designer with options practically non-existing in the selection of the correct valve timings for present state of the art engines of any kind.

In three valve designs the "F" head configuration can have two valves in the side pocket, just like a regular "L" head, except that these valves can be either both exhaust valves, both intake valves or one of each. In the latter case, then the valve on the head should be an intake valve. In three valve "OHV" designs, the same configurations just envisioned can take place, except that the valves are all located on the head and operated from above.

Since optimum operation with this chamber results with excessive combustion air, the advantages of extended design freedom in the induction and exhaust system should reflect itself in more favorable trade-offs between oxides of nitrogen emissions, BMEP, BSFC and engine thermal and mechanical loadings. The first three parameters have already been described. Engine thermal loadings with this design can also be substantially reduced mostly by the elimination of unwanted heat release before TDC, as well as by the low peak and average cycle temperatures. Exhaust valve temperature should be quite low both by the above considerations as well as by the preferred location of the exhuast valve head in the offset chamber.

Mechanical loads can be kept low mainly by the relatively low firing pressures resulting from the moderate compression ratios (relative to compression ignition engines) and the near constant pressure cycle utilized. Special emphasis is made of the high speed capabilities of the system, resulting from the improved volumetric efficiency, the absence of ignition delay and the very turbulent and fast combustion. Both the high BMEP and high speed capabilities, combined, can yield very high power to weight and power to volume ratios.

The high surface to volume ratio of the chambers herein described need not necessarily contribute to increased specific heat rejection. The principles of localized cooling utilized in conjunction with my already mentioned U.S. Pat. No. 3,945,364 and described in detail in my S.A.E. Paper 750017 "Teledyne Continental Motors Red Seal Engines, First C.P.C.S. Application" can be utilized as successfully in applications of the stratified chamber system herein being described. Tests have shown that localized cooling as described in the above mentioned S.A.E. publication can result in up to 28% less heat rejection to the coolant when compared to an otherwise similar engine operating at identical power level on the conventional Otto cycle. A further reason for even less heat rejection with the stratified chamber system herein being described results from the reduced peak and average cycle temperatures associated with high air fuel ratios and constant pressure cycle already mentioned in relation to the engine's thermal loading.

Noise levels with the system being described should also be very low, because of the absence of ignition delay, the relatively late ignition timing, the practically constant pressure combustion with very low rates of pressure rise (negative rates at all but very high loads) and the reduced cooling fan noise resulting from the reduced heat rejection rates.

The engine herein being described can utilize conventional means of sequencing the injection and spark timing, and these need not be described as they are well known in the art of internal combustion engines. Proper sequencing of the spark to the injection timing can also be achieved by systems wherein the injection is timed either mechanically or by electronic means, and the beginning of injection is detected, and triggers the occurrence of the spark or multiple sparks, whichever the case might be. With conventional mechanical injection, detection of the beginning of injection can be achieved by electronic means currently being utilized either commercially or experimentally and the physical triggering of the spark can be followed by electronic processing. In the case of electronic triggering of the injection sequence, electronic triggering of the spark can be a simple matter. In essence, with either approach, if multiple spark discharge is utilized the triggering of the first spark is not an extremely critical occurrence, and can occur even simultaneously with the injection, since enough sparks will be present to ignite the fuel cloud as it reaches the point of ignition.

The present invention achieves these advantages by the provision of a chamber within the head wherein at least a portion of the chamber extends radially beyond the projected boundaries of the cylinder and forms an air pocket adjacent the upper end of the cylinder. A fuel injection system supplies fuel to a fuel nozzle within the chamber so that the fuel is projected from the fuel nozzle into the chamber and towards the air pocket.

A spark plug or the like is disposed within the chamber and substantially within the trajectory of the injected fuel from the fuel nozzle. The spark plug is discharged to ignite the first elements of fuel emerging from the nozzle. Successive quantities of fuel delivered through the nozzle pass through the flame front from the ignited, early injection and into the air pocket. For the purpose of clarity, we may call the early part of the injected fuel "primary injection" and all successive fuel delivered as "secondary" injection without implying any physical division of both masses of fuel which may, nevertheless, exist with a properly designed system. "Primary injection" then would be that part of the total fuel delivered by the nozzle which is electrically ignited by the spark plug or ignition means, and "secondary ignition" is all the remaining quantity of fuel injected per cycle which is ignited and burned by exposure to the "flame kernel" resulting from the primary injection. The flame front, however, heats and atomizes the secondary fuel injection so that the secondary fuel injection undergoes preflame reactions before it reaches the air pocket.

In addition, the unidirectional turbulence created by the secondary fuel injection as it passes from the fuel nozzle through the chamber and into the air pocket further mixes and atomizes the secondary fuel injection.

The secondary fuel injection combustion in the air pocket expands through the chamber and into the cylinder to produce the power stroke of the piston in the conventional manner.

Preferably both the exhaust and air inlet valves are located in the chamber and, in addition, the exhaust valve is preferably positioned in registry with the air pocket and at a position spaced from the cylinder so that the hot exhaust gases from the cylinder pass entirely through the air pocket. The hot exhaust gases heat the walls of the air pocket and diminish the undesirable quenching of the second fuel injection should it impinge against the rear walls of the air pocket.

The stratified charge engine of the present invention thus achieves many advantages over the previously known stratified charge engines. In particular, by projecting the secondary fuel injection through the flame front of the ignited primary fuel injection and into the relatively large and elongated air pocket, complete mixing and atomization of the fuel occurs. This, of course, results in a more complete combustion of the secondary fuel injection so that leaner fuel/air mixtures may be utilized without the loss of engine power. A leaner fuel/air mixture is desirable not only in that a lean mixture results in fuel conservation, but also it results in the reduction of noxious emissions from the engine. In particular, nitrous oxides are greatly reduced due to the more complete mixing of the fuel with the air. Moreover, hydrocarbon emissions are likewise reduced by the reduced impingement or contact of the secondary fuel charge onto the walls of the air pocket.

Still further advantages of the stratified charge internal combustion engine of the present invention will become apparent upon reference to the following detailed decription.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DESCRIPTION OF THE PRESENT INVENTION

Figure 1:
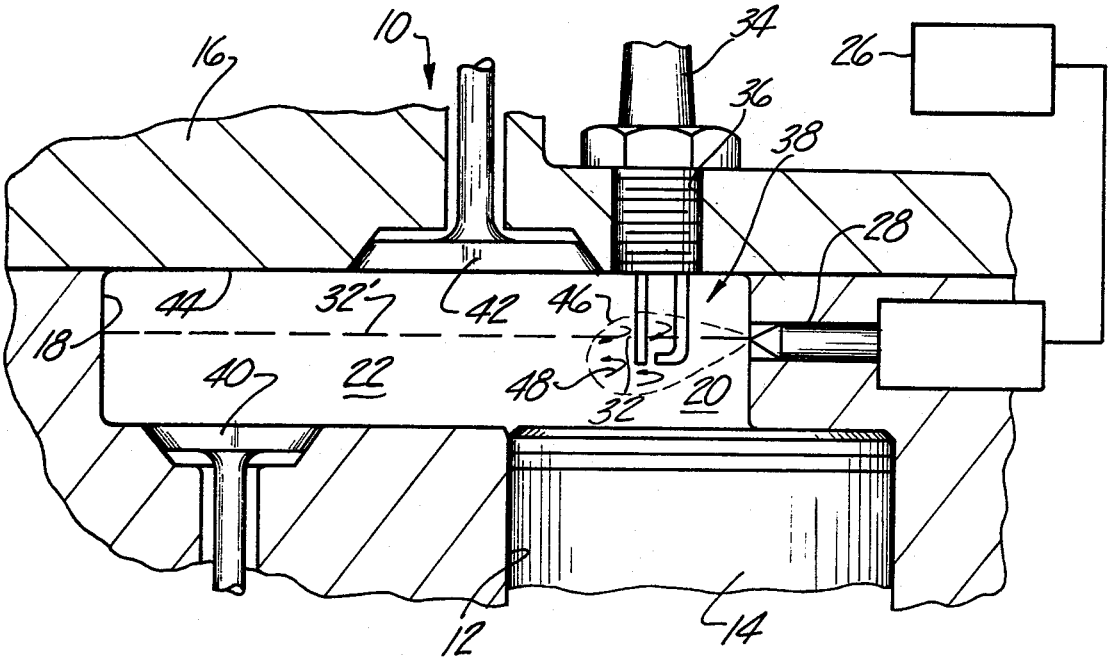
FIG. 1 is a partial cross-sectional and partial diagrammatic view illustrating one cylinder of one preferred stratified charge engine of the present invention.
Figure 2:
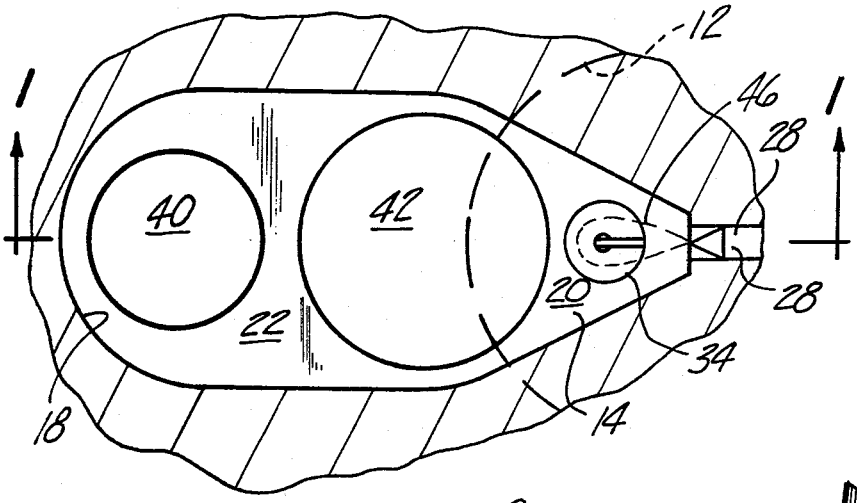
FIG. 2 is a top plan view showing one cylinder of the preferred stratified charge engine illustrated in FIG. 1.

With reference first to FIGS. 1 and 2, the stratified charge engine 10 of the present invention is thereshown and comprises at least one cylinder 12 having a piston 14 reciprocally disposed within the cylinder 12. The engine 10 preferably comprises a plurality of cylinders 12 and likewise includes the conventional piston rods, crankshaft, and the like to convert the reciprocal action of the piston 14 within the cylinder 12 into a rotary movement. These elements, however, are conventional to internal combustion engines and are therefore omitted from the drawing for the sake of brevity and of clarity.

A head 16 is secured over the cylinder 12 and includes an inner wall portion 18. The wall portion 18 in turn forms a chamber 20 axially above the piston 14 and an air pocket 22 adjacent the chamber 20 and extending radially beyond the projected boundaries of the cylinder 12. As shown in FIGS. 1 and 2, the air pocket 22 is radially elongated and comprises a relatively large percentage of the total chamber volume and preferably includes an outer curvilinear section 24 of the wall portion 18. In addition, as should be apparent from FIG. 2 the chamber 20 is relatively narrow at its inner end 50 and diverges outward into the air pocket 22. Thus the chamber 20 and the air pocket 22 form a radially elongated chamber with respect to the cylinder 12.

A fuel injection means 26 supplies fuel to a fuel nozzle 28 in the chamber 20. The fuel injection nozzle 28 projects the fuel radially through the chamber 20 and into the air pocket 22, which is illustrated diagrammatically by line 32.

A spark plug 34 is threadably secured in a bore 36 in the head 16 so that the electrodes 38 of the spark plug 34 extend downwardly into the chamber 20 and above the cylinder 12. The electrodes 38 of the spark plug 34 are disposed within the trajectory 32 of the fuel from the fuel port 28. A conventional ignition system (not shown) is coupled to the spark plug 34 and fires the spark plug 34 to ignite the first elements of fuel injected by the fuel injection nozzle 28 to form the flame front through which subsequent elements of fuel injected will pass, undergoing preflame reactions and partial burning before encountering the mass of fresh air in the air pocket 22 and completing combustion.

An exhaust valve 40 communicates with the air pocket 22 so that, when opened, the exhaust valve 40 permits the exhaust fumes from the cylinder 12 to be exhausted therethrough.

An air inlet valve 42 communicates fresh air to the chamber 20. As shown in FIG. 2, the air inlet valve 42 is preferably positioned adjacent the spark plug 34 on the top wall 44 of the chamber 20.

Still referring to FIGS. 1 and 2, the operation of the stratified engine of the present invention will now be described. Preferably the engine 10 operates in an unthrottled manner similar to a diesel engine with the opening and closing of the exhaust valve 40 and air inlet valve 42 being conventional for such engines and therefore will not be described. Likewise, the fuel injection system 26 and the ignition system for firing the spark plug 34 are also of conventional design and a detailed description of their operation will be omitted for the sake of brevity.

As the piston 14 moves upward in the cylinder 12 and approaches top dead center position, the fuel injection system 26 begins injecting fuel into the chamber 20 and along the trajectory 32. As these early elements of fuel reach the spark plug 34, the ignition system is discharged and the mixture is ignited by the spark plug 34 in the conventional manner initiating the propagation of a flame front through the chamber 20 which is shown schematically by line 46. The continued injection of subsequent elements of fuel, with the piston already past TDC, forces the fuel past the already established flame front 46, continually moving the leading edge of such flame front towards the air pocket 22. As expansion takes place, the fresh air in pocket 14 moves out into the chamber 20, meeting the flame front 46 which contains a hot and rich mixture of fuel and air in different stages of oxidation, and assuring total combustion of the fuel injected by the excessive quantities of air present.

The projection of the fuel injection through the flame front 46 and into the air pocket 22 achieves two distinct advantages over the previously known stratified charge engines. First the relatively long projectory 32 and 32' of the fuel injection, made possible by the elongated air pocket 22, and the strategic location of the squish areas creates a unidirectional turbulence through the chamber 20 and the air pocket 22 as shown by the small arrows 28. The turbulence 28 aids in mixing the fuel with the air within the chamber 20 and the air pocket 22 and thereby furthers the atomization of the fuel.

Secondly, as the secondary fuel injection passes through the flame front 46, the flame front heats the fuel so that the fuel undergoes preflame reactions and some partial burning. The rate of combustion as the fuel is injected into the flame front is controlled by the relatively small quantity of air present in the main chamber 20, but as the hot atomized fuel and partial products of combustion reach the air in the side pocket 22 very fast combustion results.

The combination of the unidirectional turbulence and the passage of the main fuel charge through the flame front 46 provides the means to achieve the maximum air/fuel mixing required to obtain the fast and complete burn of the fuel needed to guarantee constant pressure combustion through the early part of the expansion stroke. After ignition, then, the early part of combustion takes place rather slowly due to the small size of the chamber near the spark plug and fuel injection nozzle, plus the low amounts of air present, but very fast rates of combustion are achieved later in the expansion stroke as fuel mixing of the main charge of air and fuel takes place.

The placement of the exhaust valve 40 adjacent the curvilinear section 24 of the air pocket 22 serves to draw the hot exhaust fumes from the cylinder 12 through the air pocket 22 and past the valve 40. This serves to heat up the walls of the air pocket 22 which prevents quenching of the secondary fuel injection should it impinge upon the walls of the air pocket 22. These walls can in addition, be cast extra thick to further reduce heat losses and enhance combustion.

Like the exhaust valve 40, the placement of the air inlet valve 42 in a more centralized location permits increased air flow and reduced pumping losses by allowing for fairly large port size and valve diameter.

Figure 3:
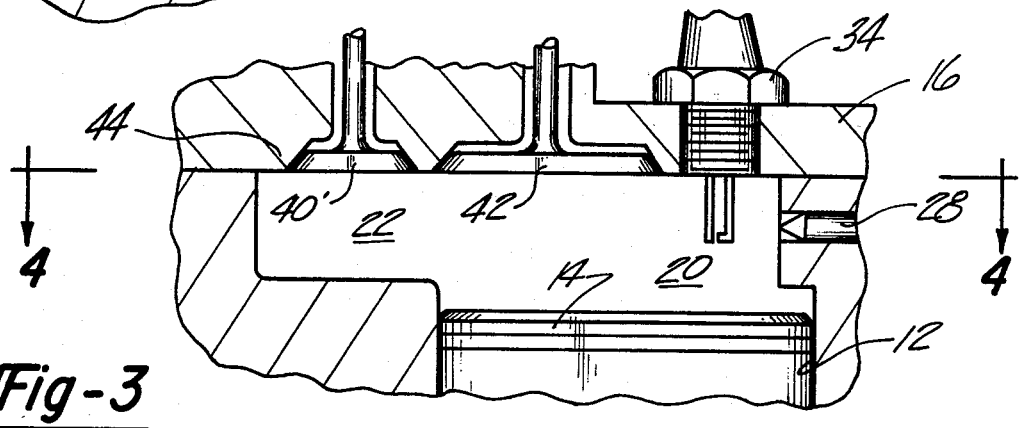
FIG. 3 is a partial cross-sectional view similar to FIG. 1 but showing a modification thereof.
Figure 4:
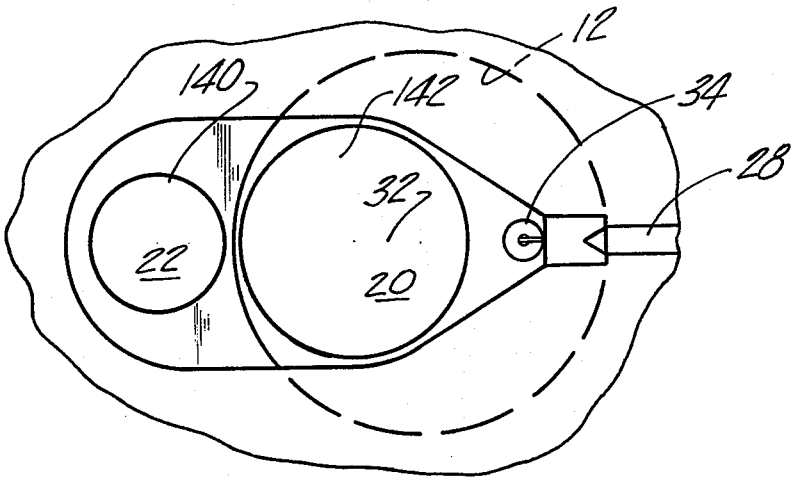
FIG. 4 is a top plan view taken along line 4—4 in FIG. 3.

A modification to the present invention is illustrated in FIGS. 3 and 4 and is particularly designed for an overhead valve engine. In contrast to the embodiment shown in FIGS. 1 and 2, the exhaust valve 140 communicates with the air pocket 22 through the top wall 44 of the air pocket 22 rather than through the bottom surface of the pocket 22. The exhaust valve 140, however, is still positioned so that the exhaust gases heat the walls of the air pocket 22.

Figure 5:
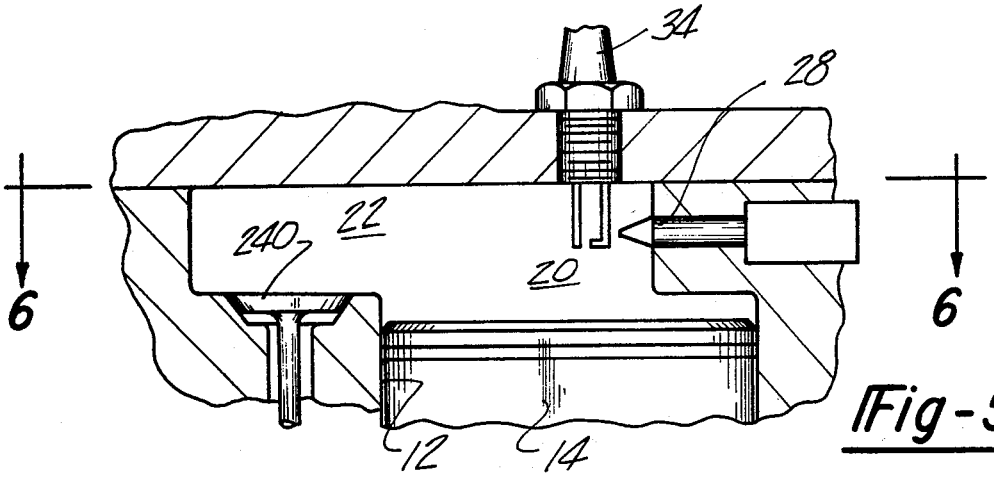
FIG. 5 is a partial cross-sectional view similar to both FIGS. 1 and 3, but showing a still further modification thereof.
Figure 6:
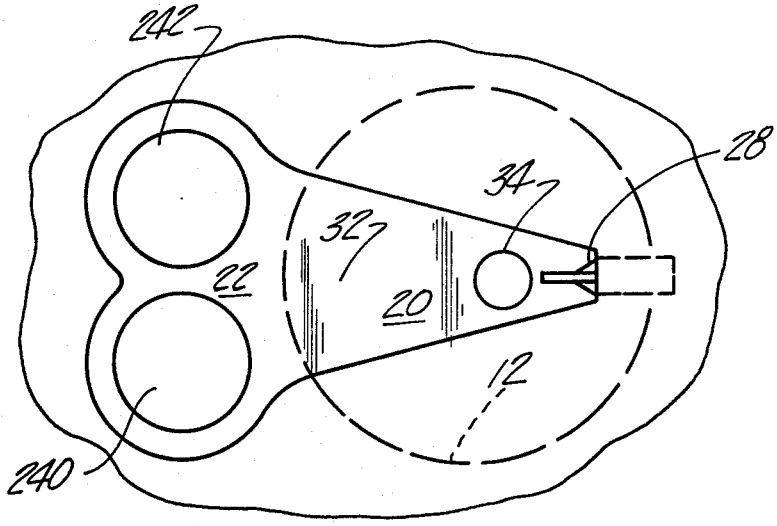
FIG. 6 is a top plan view taken substantially along line 6—6 in FIG. 5.

FIGS. 5 and 6 illustrate a still further valve arrangement in which both the exhaust valve 240 and the air inlet valve 242 communicate with the air pocket 22 rather than the chamber 20. Although somewhat limited in maximum BMEP capabilities, mostly because of the restricted breathing, this arrangement nevertheless allows for more freedom is positioning the nozzle and spark plug and can still yield very good operation and low oxides of nitrogen emissions, especially at light loads.

Having described my invention, many modifications thereto will become apparent to those skilled in the art to which it pertains without deviating from the spirit of the invention as defined by the scope of the appended claims.

What is claimed is:

1. In a internal combustion engine having a cylinder, a piston reciprocally disposed in said cylinder, and a head secured over said cylinder, the improvement which comprises:

a wall portion in said head, said wall portion forming a chamber above said cylinder and an air pocket adjacent said chamber and radially beyond the projected boundaries of said cylinder said wall portion providing an unrestricted communication between said combustion chamber and said air pocket at every position of said piston, fuel injection means having a nozzle for directing a stream of fuel through said chamber and into said air pocket in a direction substantially perpendicular to the movement of said piston, fuel ignition means for igniting said fuel, said fuel ignition means extending into said chamber substantially in the trajectory of said stream of fuel, and an exhaust valve and an air inlet valve in communication with said wall portion.

2. The invention as defined in claim 1, wherein said ignition means ignites the first elements of fuel introduced into the chamber by the fuel injection means.

3. The invention as defined in claim 2, wherein secondary elements of the injected fuel are projected through the flame front from the combustion of said primary fuel elements and into said air pocket.

4. The invention as defined in claim 1, wherein said exhaust valve communicates with said wall portion in said air pocket.

5. The invention as defined in claim 4, wherein said air inlet valve communicates with said wall portion in said chamber.

6. The invention as defined in claim 1, wherein said air pocket encompasses substantially one third the total combustion chamber volume.

7. The invention as defined in claim 1, wherein said chamber and said air pocket are elongated in the direction of the trajectory of the fuel injection means.

8. The invention as defined in claim 4, wherein said air inlet valve communicates with said wall portion in said air pocket.

* * * * *

UNITED STATES PATENT AND TRADEMARK OFFICE

CERTIFICATE OF CORRECTION

PATENT NO. : 4,111,177

DATED : September 5, 1978

INVENTOR(S) : Jose F. Regueiro

It is certified that error appears in the above-identified patent and that said Letters Patent are hereby corrected as shown below:

Column 9, line 1, delete "is" and insert --in-- therefor;

Signed and Sealed this

*Sixth* Day of *March 1979*

[SEAL]

*Attest:*

RUTH C. MASON
*Attesting Officer*

DONALD W. BANNER
*Commissioner of Patents and Trademarks*